US010295961B2

(12) United States Patent
Oliveira

(10) Patent No.: US 10,295,961 B2
(45) Date of Patent: May 21, 2019

(54) PROCESS FOR DECORATING A TIMEPIECE COMPONENT AND TIMEPIECE COMPONENT OBTAINED BY SUCH A PROCESS

(71) Applicant: ROLEX SA, Geneva (CH)

(72) Inventor: Alexandre Oliveira, Amancy (FR)

(73) Assignee: ROLEX SA, Geneva (CH)

( * ) Notice: Subject to any disclaimer, the term of this patent is extended or adjusted under 35 U.S.C. 154(b) by 327 days.

(21) Appl. No.: 15/068,210

(22) Filed: Mar. 11, 2016

(65) Prior Publication Data

US 2016/0266551 A1 Sep. 15, 2016

(30) Foreign Application Priority Data

Mar. 13, 2015 (EP) ..... 15158934

(51) Int. Cl.

| | |
|---|---|
| ***G04D 3/00*** | (2006.01) |
| ***G04B 19/10*** | (2006.01) |
| ***B41F 17/00*** | (2006.01) |
| ***B41C 1/05*** | (2006.01) |
| *B44C 1/00* | (2006.01) |

(52) U.S. Cl.

CPC ..... *G04D 3/0092* (2013.01); *B41C 1/05* (2013.01); *B41F 17/001* (2013.01); *G04B 19/10* (2013.01); *B44C 1/00* (2013.01)

(58) Field of Classification Search

CPC ..... B23K 26/00; G04B 3/04; G04B 19/10; G04B 19/12; G04D 3/0092; B41C 1/05

See application file for complete search history.

(56) References Cited

U.S. PATENT DOCUMENTS

2010/0220559 A1* 9/2010 Galie ..... G04C 3/008 368/220
2013/0000500 A1 1/2013 Philipp
2015/0049593 A1* 2/2015 Oliveira ..... B44C 1/228 368/276

(Continued)

FOREIGN PATENT DOCUMENTS

DE 10 2011 078 532 B3 7/2012
EP 1 075 946 A1 2/2001

(Continued)

OTHER PUBLICATIONS

European Search Report and Written Opinion dated Jul. 14, 2015 issued in counterpart European application No. 15158934; w/ English partial translation and partial machine translation (11 pages).

*Primary Examiner* — Jill E Culler
*Assistant Examiner* — Marissa Ferguson-Samreth
(74) *Attorney, Agent, or Firm* — Westerman, Hattori, Daniels & Adrian, LLP

(57) ABSTRACT

A process for decorating a dial includes a step (E1) of engraving a pattern in a pad-printing cliché with a femto-second laser, then a step (E20) of transferring said pattern to the dial using the pad-printing cliché. The process can include surface structuring of the dial, then transferring the pattern to the dial at least partially superposed on surface-structuring obtained by the surface structuring, and can also include an intermediate coloring of the decorated or to be decorated surface in the surface structuring, using a different color from the color used in the transferring.

23 Claims, 2 Drawing Sheets

(56) References Cited

U.S. PATENT DOCUMENTS

Figure 1:
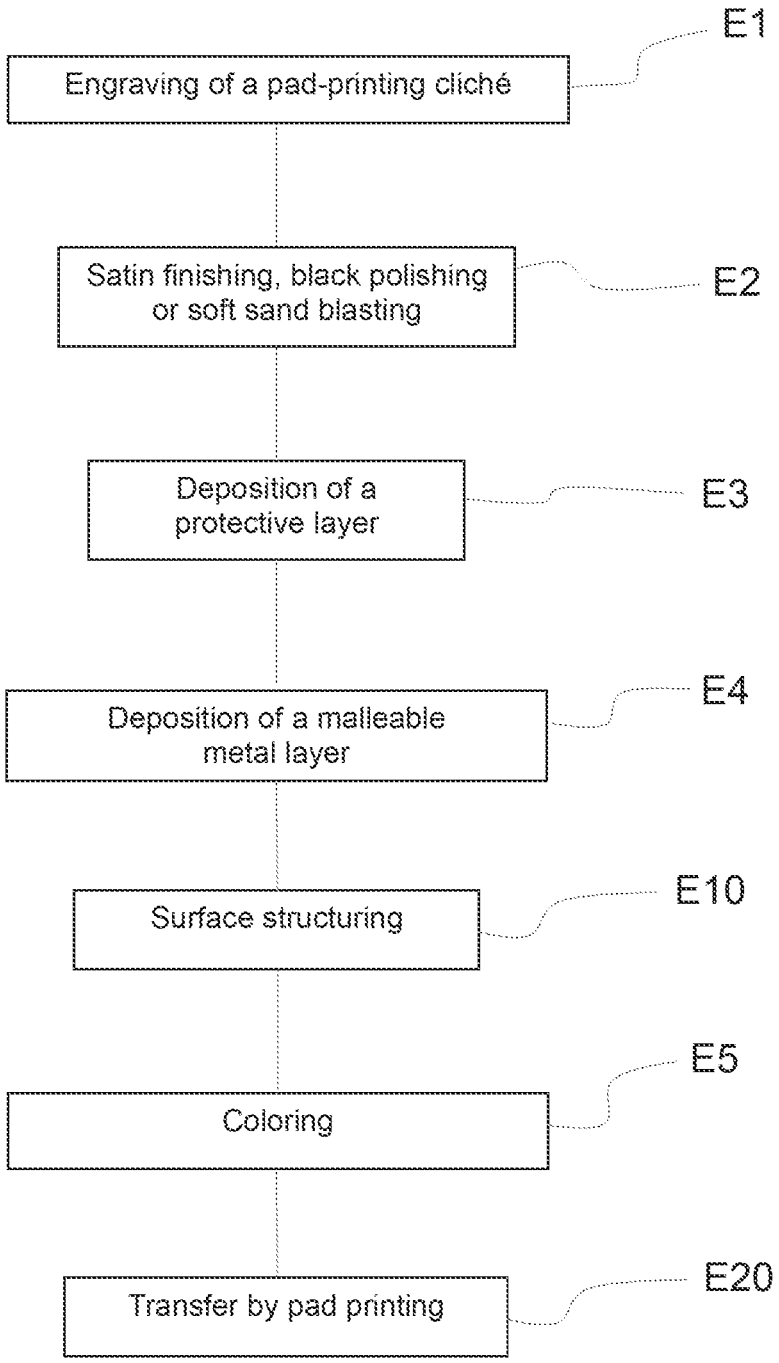

2016/0263698 A1* 9/2016 Noirot ..... B23K 26/0006

FOREIGN PATENT DOCUMENTS

| | | | | | |
|---|---|---|---|---|---|
| FR | 2 288 795 | A1 | | 5/1976 | |
| JP | 60044886 | | * | 3/1985 | ..... G04B 119/06 |
| WO | 02/090116 | A1 | | 11/2002 | |
| WO | 2013135703 | | * | 9/2013 | ..... B44C 1/228 |

* cited by examiner

Fig.2
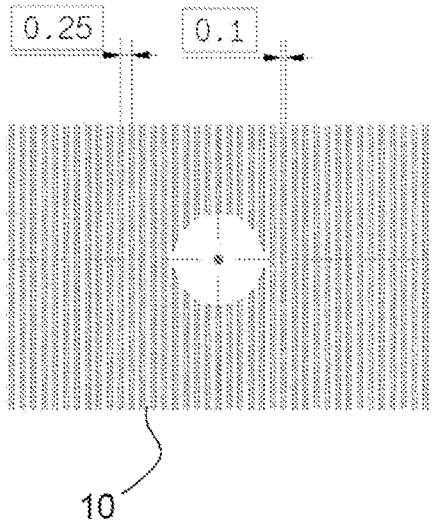
Fig.3
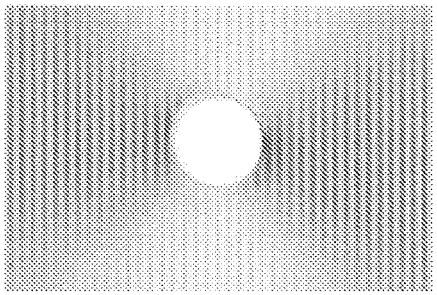
Fig.4
| | SCI - L* | SCI - a* | SCI - b* |
|---|---|---|---|
| **1st example** | | | |
| E10 = silver sunray brushing | 99,2 | 0,7 | 8,1 |
| E20 = blue lacquer | 69,9 | -19,5 | -26,3 |
| E10 + E20 => pastel blue decoration | 86 | -6,9 | -5,7 |
| **2nd example** | | | |
| E10 = silver sunray brushing | 99,2 | 0,7 | 8,1 |
| E20 = green | 83 | -19 | 31 |
| E10 + E20 => pastel green decoration | 91,8 | -6 | 17,6 |
| **3rd example** | | | |
| E10 = silver sunray brushing | 99,2 | 0,7 | 8,1 |
| E20 = mauve | 76,4 | 8,7 | -16,5 |
| E10 + E20 => pastel mauve decoration | 89,1 | 4,3 | -0,9 |

PROCESS FOR DECORATING A TIMEPIECE COMPONENT AND TIMEPIECE COMPONENT OBTAINED BY SUCH A PROCESS

The invention relates to a process for decorating a timepiece component, especially a watch component. It also relates to a timepiece component as such obtained by implementing such a process. Lastly, the invention also relates to a timepiece, especially a watch, for example a wristwatch, comprising such a timepiece component.

When it is desired to produce an adornment on a timepiece component, such as a dial, it is known to structure the surface, conventionally with a transfer or milling process for example. Such a prior-art approach comprises a single step of machining the surface to be decorated, in order to produce a chosen surface finish. As a variant, markings may be produced, for example by a transfer that allows inscriptions to be added to the surface, in general using a pad comprising an engraved and inked cliché.

Existing decorating solutions are unsatisfactory. Specifically, it should be noted that horology applications place high demands on such a decorating process: the aesthetic effect obtained is very important and the milling, coloring and/or marking must be free from defects or smudges. Lastly, the choice of decorations producible with these existing solutions is limited to a few well-known long-standing solutions, thereby making it impossible to offer original decorating solutions.

The aim of the invention is to provide a process for decorating a timepiece component, especially a dial, that allows an aesthetic effect that is attractive and precise and durable over time to be obtained simply.

For this purpose, the decorating process comprises a step of engraving a pattern in a pad-printing cliché with a femtosecond laser, then comprises a step of transferring said pattern to a dial using the pad-printing cliché.

This decorating process is advantageously combined with a step of surface structuring the surface to be decorated of the dial.

A decorating process, a dial and a timepiece according to the invention are defined by the claims.

The subject matter, features and advantages of the present invention will be described in detail in the following non-limiting description of one particular embodiment given with reference to the appended figures, in which:

FIG. 1 schematically shows the steps of the decorating process according to one embodiment of the invention.

FIG. 2 schematically shows a horizontal projection of a transfer according to one embodiment of the invention.

FIG. 3 schematically shows a top view of a timepiece component obtained after decoration according to the embodiment of the invention.

FIG. 4 shows the color measurements obtained on samples during the implementation of all and some of the steps of the decorating process according to three exemplary implementations of one embodiment of the invention.

According to the method of implementation of the decorating process of the invention, the possibilities created by femtosecond laser machining are used to produce a pad-printing cliché that will be used in a step to decorate a timepiece component, made of a mass of a metal or non-metal, in particular in combination with another decorating technique according to one embodiment. This approach has the advantage of greatly increasing the number of ways in which a timepiece component may be decorated.

The invention will now be illustrated nonlimitingly in the context of the decoration of a watch dial. It could naturally be used to decorate another timepiece component, of a wristwatch or of a timepiece movement, such as for example and nonlimitingly, a bezel, blank-movements and movement parts.

The decorating process according to the embodiment first comprises a step E1 of engraving a pad-printing cliché using a femtosecond laser, in order to form a decorative pattern. The femtosecond laser is used in such way that it allows an engraving to be generated, the obtained extreme fineness of which then allows very fine patterns to be transferred to the dial, especially patterns formed by fine lines corresponding to the engravings of the cliché. According to the embodiment, this very fine pattern allows surprising and seducing effects, such as for example a color rendering different from the color of the start ink of the cliché and from the color of the background dial, to be obtained, as will be described below. The use of a femtosecond laser machining technique to produce a pattern intended to be transferred by pad printing thus opens up new and very exciting possibilities for the production of timepiece dials, and more generally any timepiece component.

A femtosecond laser is a particular type of laser that produces ultra-short pulses the duration of which is about a few femtoseconds to a few hundred femtoseconds (1 fs=1 femtosecond=$10^{-15}$ seconds). Thus, to engrave a cliché made of metal, the femtosecond laser may for example generate pulses of 1030 nm wavelength and 20 μJ energy with a pulse rate of 500 kHz and with a pulse duration of 270 fs. Naturally, these numerical values are given by way of example and may take other values. The wavelength may be variable in a certain range possibly extending from 300 nm and 1100 nm, typically 343 nm for glass or alumina. The duration of the pulses may be variable in a range possibly extending from 200 fs to 500 fs.

An optical system is used to form the beam, said system being composed of various components in order to adjust the energy delivered, the polarization of the beam and its size. The beam is scanned over the target (surface of the pad-printing cliché) by an electronically controlled optical device for deviating the beam. It allows the desired patterns to be produced by way of control software.

For example, F-theta lenses, of 100 mm and 160 mm focal length are used in the embodiment to allow machining of an area (field) of 72 mm and 121 mm diameter, respectively. The use of an F-theta lens of 60 mm focal length decreases the area (field) to a diameter of 46 mm. The scanning head is controlled by a marking software package associated with a digital control board allowing the movement of the beam to be synchronized with the firing of the laser. This assembly makes it possible to modify, inter alia, the speed of the movement of the laser beam over the surface to be engraved, the laser scanning strategy and lastly the number of strokes over a given zone. The micro-positioning system is controlled along/about five axes, namely three translational axes and two rotational axes. The depth of the engraving obtained may be adjusted with the number of strokes and therefore the number of repetitions of the scanning pattern: the higher the number of strokes, the deeper the recess will be. In any case, the removal of material resulting from this engraving step produces a recess of average depth larger than or equal to 4 μm.

Thus, the decorating process comprises a particular step E20, which is separate or comprising any of the other conventional markings mentioned below, of transferring from the pad-printing cliché produced in the prior step E1 described above. The superposition of such a transfer on the surface of the dial to be decorated allows unexpected effects to be achieved.

The invention does not relate to the pattern produced by this engraving step, which makes it possible to produce any curve by moving the beam along a chosen path, and in particular parallel or substantially parallel lines.

The decorating process may comprise optional complementary steps. The complete process, including the optional steps, is illustrated by FIG. 1.

According to one embodiment, the decorating process comprises an initial step of preparing the surface of the dial to be treated. To do this, the plate that forms the dial, which for example is made of a metal such as brass, is polished, washed and degreased. As a variant, the dial, or any other timepiece component to be decorated, may be made of another metal, the term metal including a pure metal or any metal alloy, such as steel, titanium, gold or platinum. Alternatively, it is also possible to imagine a timepiece component comprising a start plate made of a ceramic, for example of zirconia or alumina, of silicon, of glass, of sapphire, of mother-of-pearl or of a mineral material, the face of which shows the natural color of the material or which is colored a given color, white for example.

Optionally, the decorating process comprises a complementary treatment step E2 of satin finishing, brushing or soft sand blasting. This step E2 may be carried out at any moment of the decorating process before the transferring step E20.

Likewise, optionally, the decorating process comprises a step E3 of depositing an optional layer, preferably of thickness comprised between 0.2 and 1 μm inclusive, in order to protect the dial from oxidation and/or to give it a color.

Next, the process according to the embodiment optionally comprises a step E4 of depositing a metal layer. Preferably, this deposited metal comprises silver, which is sufficiently malleable to be structured during the following operations, especially the surface-structuring step E10. Of course a layer of a malleable metal other than silver may be deposited to facilitate this machining operation.

The surface-structuring step E10 comprises an operation of machining a decoration into the surface to be decorated of the timepiece component, which may, according to one advantageous example, be a sunray brushing operation, which consists in producing shallow scratches in the surface of the dial with a brush and/or an abrasive paste. As a variant, this step may comprise soft sand blasting and/or sand blasting. In the case of sunray brushing, a fine network of streaks will be produced, for example in a silver layer, as will be mentioned below, and that gives the part a sun-like appearance.

Of course it is possible to imagine using a technique other than the aforementioned sunray-brushing, soft sand blasting and sand-blasting techniques in this surface-structuring step, depending on the final appearance that it is desired for the dial to have. By way of example, here are other possible techniques that may be implemented in this surface treatment:

- satin finishing and brushing, which like soft sand blasting give a very fine and shallow texture;
- circular graining, consisting in producing fine concentric circles that bring a surface to life;
- diamond polishing, creating a very smooth polish;
- the production of Côtes de Genève, which form a pattern of bands of angled brushed zones, of variable width and fineness; the bands of cÔtes having a more or less pronounced separation. The abrasive or brush marks the surface with straight or circular parallel striations that form the cotes;
- spotting, which is an adornment made up of concentric circles that are very closely spaced or that even overlap one another; and
- snailing, which is a spiral-shaped adornment obtained by means of a milling cutter that is rotated on the surface of the part while orientating it so as to obtain spiral marks.

In the end, the surface structuring produces a shallow adornment by controllably scratching the surface of the part. The tools used may for example be abrasive-covered buffers or brushes. This surface-structuring step generates a surface roughness preferably comprised between 0.05 and 0.1 μm. Thus, the expression "surface structuring" refers to any step that allows a modification of the surface to be decorated to be generated over a small thickness; smaller than or equal to 1 μm, or even 0.3 μm, or even 0.1 μm. This structuring forms, over the mentioned thickness, regular and organized scratches that are preferably sufficiently dense to be visible, forming a particular weft procuring an attractive visual appearance.

A color-adding layer or series of layers may then optionally be deposited in a step E5 preceding the transferring step E20, for example by way of one or more electroplated layers and/or one or more layers formed by PVD (physical vapor deposition), and/or one or more layers formed by ALD (atomic layer deposition) or by any other deposition technique allowing a coating liable to modify the perceived color of the dial to be formed. It is possible to deposit the colored layer on only one portion of the dial by masking techniques, or to deposit a plurality of layers of different colors in different locations on the surface of the dial.

The decorating process was illustrated above by way of example, and it is possible to invert the order of certain steps, such as to produce the surface structuring, especially the sunray brushing, after a step of depositing a colored layer, for example.

In general, a lacquer is then deposited; then a conventional transfer with markings (letters, numbers, markers, railroads, other signs) may be applied to the dial.

Lastly; the decorating process comprises the aforementioned particular step E20, which is separate or comprising any of the other aforementioned conventional markings, of transferring from the pad printing cliché produced in the prior step E1 described above. The superposition of such a transfer on the surface produced beforehand allows unexpected effects to be achieved.

It is possible to invert the order of the latter steps, such as to carry out the transfer E20 before the conventional transfer and/or the deposition of the lacquer.

Optionally, the finished dial may also include appliques, such as luminescent markers or settings for precious stones.

FIGS. 2 and 3 illustrate an exemplary implementation of the decorating process described above. FIG. 2 firstly shows the horizontal projection of the transfer. This result was obtained using a femtosecond laser, and with the following parameters to form the engravings on the pad-printing cliché:

- laser beam diameter at the focal point: 20 to 40 μm;
- lateral separation between 2 engravings: between 100 and 250 μm; and
- engraving depth: 15 μm.

The degrees of lateral and longitudinal overlap are comprised between 0% and 99%; they are 0% and 95% for this exemplary embodiment, respectively. The power densities must be above the ablation threshold of the material; and are typically about $4.19\times10^6$ MW/cm$^2$.

FIG. 3 shows the final decoration obtained on the dial after the step E20 of transferring by pad printing, applied to a surface structure consisting of a sunray brushing.

The fact that fine, parallel and closely spaced lines are used in the pad printing step allows particularly advantageous results to be achieved. The cliché engraving depth (thus also indirectly the width of the engraving and the thickness of the lines formed) and the lateral distance between two engravings in the pad-printing cliché are two important criteria as regards the creation of aesthetic effects:

By way of example, when the pattern of the pad-printing cliché contains lines of 150 μm width spaced apart by 150 μm, then the result obtained is advantageous. In such a case, the various individual lines are distinguishable by eye. Such a case may be achieved with fine lines of thickness comprised between 100 and 300 μm inclusive and/or spaced apart by 100 to 300 μm inclusive;

When the two preceding dimensions (line width and space between the lines), which may be equal or different, and regular or irregular, but which preferably form, in a given pattern, a regular weft, are yet smaller, for example smaller than or equal to 100 μm, or even smaller than or equal to 70 μm, or even smaller than or equal to 60 μm, then the eye is no longer able to distinguish the various individual lines and combines them, thereby allowing original effects to be created, for example by way of optical illusions. The example in FIG. 2 is close to this configuration since it comprises lines 10 of 100 μm width spaced apart by 250 μm.

The second case mentioned above may advantageously be combined with particular colors to achieve surprising effects. For example, FIG. 3 shows an embodiment in which the dial was first decorated by sunray brushing a coloring layer of a silvery, champagne or blue color (deposited by PVD or electroplating as described above). Next, transfers, for example of an ink of blue, red, pink or mauve color, are carried out. An optical effect is achieved that lightens the colors of the end result. From an ink of saturated color, they appear on the dial as pastel colors, with a good depth. Thus, in this second case, the eye is tricked and perceives a color that is not actually present on the dial, but that results from the combination of the respective colors of the transfer and of the color of the sun brushed dial.

By way of noteworthy examples, a transfer of a mauve ink to a layer of silvery color produces a resultant pastel mauve color. A transfer of blue ink to a layer of champagne colour produces a resultant tender green color. FIG. 4 illustrates this effect using a table of values corresponding to three examples. The colors are measured by the CIE Lab method, and its three parameters L*, a*, b*. In each example, the decorating process implements a surface-structuring step consisting in a silver sunray brushing obtained in a sunray surface-structuring step E10 carried out after a prior step E4 of depositing a silver layer. In the first case, the transfer is carried out using a blue lacquer, thereby allowing a resultant decoration of pastel blue color to be achieved. In the second case, the transfer is carried out using a green lacquer, thereby allowing a resultant decoration of pastel green color to be achieved. In the third case, the transfer is carried out using a mauve lacquer, thereby allowing a resultant decoration of pastel mauve color to be achieved.

It is important to use a femtosecond laser if a precise pattern taking the form of a very regular weft is to be produced on the pad-printing cliché, this being necessary if the aforementioned effects are to be obtained. In addition, a femtosecond laser makes it possible to be very precise and to define the thickness of the engraving, the depth of the engraving and the distance between the engravings very precisely. The same process implemented with a pad-printing cliché formed without a femtosecond laser would not allow these optical effects to be achieved and, in the end, in no way achieves the same final appearance.

As mentioned above, the decorating process allows a multitude of very attractive and original results to be achieved, and the invention is not limited to the examples described above. By way of example it is possible to choose:

Patterns formed from lines or intersecting lines, or spots and lines in alternation;

Prints of two different colors, such as for example one line in two of a first color, the other lines being in a second color; and The material from which the cliché is made may be a metal, for example steel, or a ceramic, or glass, though it may be made of any other suitable material.

The two combined types of adornment are at least partially superposed. The print formed by the transfer defines a pattern at least partially superposed on the surface having undergone surface structuring. The printed patterns may thus cross lines printed by the transfer with striations formed by the surface structuring.

The invention also relates to the timepiece component obtained by this decorating process. Such a component thus comprises adornments in relief comprising a print obtained by pad printing superposed on a surface structure.

The invention claimed is:

1. A process for decorating a dial, comprising:

coloring of a surface to be decorated of the dial, using a first color, and engraving a pattern in a pad-printing cliché with a femtosecond laser, then, after the coloring and engraving, transferring the pattern to the dial using the pad-printing cliché, wherein a second color used in the transferring is at least partially superposed on the first color obtained by the coloring.

2. The process for decorating a dial according to claim 1, comprising surface structuring the surface to be decorated of the dial, wherein the pattern transferred to the dial is at least partially superposed on a surface structure obtained by the surface structuring.

3. The process for decorating a dial according to claim 2, wherein the surface structuring comprises sunray brushing, or soft sand blasting, or sand blasting, or spotting, or the production of Côtes de Genève, or snailing.

4. The process for decorating a dial according to claim 2, wherein the surface structuring produces a weft of regular reliefs of average depth smaller than or equal to 1 μm.

5. The process for decorating a dial according to claim 2, comprising depositing a metal layer on the surface to be decorated, before the surface structuring.

6. The process for decorating a dial according to claim 5, wherein the metal layer deposited is a layer of a malleable metal.

7. The process for decorating a dial according to claim 2, wherein the coloring of the decorated surface is performed after the surface structuring and before the transferring by pad printing, by at least one selected from the group consisting of (i) depositing at least one layer selected from the group consisting of one or more electroplated layers, one or more PVD layers, and one or more ALD layers, and (ii)

depositing by another technique a coating, wherein the coloring modifies the perceived color of the dial to be formed after the transferring.

8. The process for decorating a dial according to claim 2, wherein the pattern of the pad-printing cliché is so that the pattern allows a color of the final decoration different from the first color of the surface to be decorated of the dial after the surface structuring and from the second color used in the transferring to be perceived.

9. The process for decorating a dial according to claim 2, wherein the surface structuring produces a weft of regular reliefs of average depth smaller than or equal to 0.3 μm.

10. The process for decorating a dial according to claim 1, wherein the engraving a pad-printing cliché produces wefts comprising lines, at least one of the thickness and spacing of which is smaller than or equal to 150 μm.

11. The process for decorating a dial according to claim 1, wherein the pattern of the pad-printing cliché is so that the pattern allows a color of the final decoration different from the first color of the surface to be decorated of the dial and different from the second color used in the transferring to be perceived.

12. A dial obtained by a decorating process according to claim 1, comprising a decorated surface comprising a first color formed by coloring and a print transferred using a pad-printing cliché formed by a process including engraving with a femtosecond laser and comprising a second color, wherein the second color is at least partially superposed on the first color.

13. The dial according to claim 12, comprising at least one surface structure, the transferred print being at least partially superposed on the at least one surface structure.

14. The dial according to claim 13, comprising a first color covering the surface structure, and a superposed transferred print of a second color different from the first color, wherein an overall decoration of the dial is visible as a pastel color or a third color different from the first color and from the second color.

15. The dial according to claim 12, comprising a transferred print comprising lines, at least one of the thickness and spacing of which is smaller than or equal to 150 μm.

16. The dial according to claim 12, wherein the dial is made of metal, or of a ceramic, or of silicon, or of glass, or of sapphire, or of mother-of-pearl or of a mineral material.

17. A timepiece, comprising a dial according to claim 12.

18. The dial according to claim 12, comprising a transferred print comprising lines, at least one of the thickness and spacing of which is smaller than or equal to 100 μm.

19. The dial according to claim 12, wherein the coloring is at least one selected from the group consisting of (i) at least one layer selected from the group consisting of one or more electroplated layers, one or more PVD layers, and one or more ALD layers, and (ii) at least one coating deposited by another technique, wherein the coloring modifies the perceived color of the dial formed after the transferring.

20. The dial according to claim 12, wherein an overall decoration of the dial is visible as a pastel color or a third color different from the first color and from the second color.

21. The process for decorating a dial according to claim 1, wherein the engraving a pad-printing cliché produces wefts comprising lines, at least one of the thickness and spacing of which is smaller than or equal to 100 μm.

22. The process for decorating a dial according to claim 1, wherein the coloring of the surface to be decorated of the dial, before the transferring by pad printing, is performed by at least one selected from the group consisting of (i) depositing at least one layer selected from the group consisting of one or more electroplated layers, one or more PVD layers, and one or more ALD layers, and (ii) depositing by another technique at least one coating, wherein the coloring modifies the perceived color of the dial to be formed after the transferring.

23. The process for decorating a dial according to claim 1, wherein an overall decoration of the decorated dial is visible as a pastel color or a third color different from the first color and from the second color.

* * * * *